US008695197B2

(12) United States Patent
Schrubke et al.

(10) Patent No.: US 8,695,197 B2
(45) Date of Patent: Apr. 15, 2014

(54) METHOD FOR PRODUCING A COATED EXTENSION GUIDE

(75) Inventors: Lars Schrubke, Kirchlengern (DE); Daniel Reidt, Herford (DE); Willi Grigat, Bielefeld (DE); Arthur Krause, Lübbecke (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 103 days.

(21) Appl. No.: 13/395,836

(22) PCT Filed: Sep. 15, 2010

(86) PCT No.: PCT/EP2010/063544

§ 371 (c)(1),
(2), (4) Date: Jul. 11, 2012

(87) PCT Pub. No.: WO2011/032982

PCT Pub. Date: Mar. 24, 2011

(65) Prior Publication Data

US 2012/0304450 A1 Dec. 6, 2012

(30) Foreign Application Priority Data

Sep. 15, 2009 (DE) ..... 10 2009 044 011

(51) Int. Cl.

| | |
|---|---|
| ***B21D 53/00*** | (2006.01) |
| ***B23P 11/00*** | (2006.01) |
| ***F24C 15/16*** | (2006.01) |
| ***A47B 96/06*** | (2006.01) |

(52) U.S. Cl.
USPC ..... 29/434; 29/460; 29/81.08; 29/81.09; 126/339; 312/334.1

(58) Field of Classification Search
USPC ..... 29/81.08, 81.09, 90.7, 434, 460, 469; 126/339; 211/153; 248/200.1, 125.8, 248/161, 157; 312/334.1
See application file for complete search history.

(56) References Cited

U.S. PATENT DOCUMENTS 5,570,943 A * 11/1996 Schroder et al. ..... 312/334.11
7,296,863 B2 * 11/2007 Lam et al. ..... 312/334.6

(Continued)

FOREIGN PATENT DOCUMENTS

| | | |
|---|---|---|
| DE | 199 44 390 | 4/2001 |
| DE | 101 31 156 | 1/2003 |
| DE | 10 2004 008 766 | 9/2005 |
| DE | 10 2004 019 102 | 11/2005 |
| EP | 1 607 685 | 12/2005 |

(Continued)

OTHER PUBLICATIONS

German Search Report corresponding to Application No. DE 10 2009 044 011.9 dated Sep. 15, 2009.

*Primary Examiner* — Jermie Cozart
(74) *Attorney, Agent, or Firm* — Barnes & Thornburg LLP

(57) ABSTRACT

A method for producing a coated pull-out guide for baking ovens, the pull-out guide including a guide rail and at least one of a middle rail and a running rail displaceably supported by rolling elements on the guide rail. The rolling elements are guided along tracks on one or more of the guide rail, middle rail and running rail. The method includes the steps of: assembling the pull-out into a unit including one or more of the guide rail, middle rail, and running rail; cleaning a metal surface of at least one of the rails by one or more of a mechanical and chemical cleaning method; and, applying a coating to the cleaned metal surface.

15 Claims, 1 Drawing Sheet

(56) References Cited

U.S. PATENT DOCUMENTS

| | | | |
|---|---|---|---|
| 2003/0172952 | A1 | 9/2003 | Takase et al. |
| 2003/0207145 | A1 | 11/2003 | Anderson et al. |
| 2008/0092806 | A1 | 4/2008 | West et al. |

FOREIGN PATENT DOCUMENTS

| | | |
|---|---|---|
| EP | 1 873 460 | 1/2008 |
| WO | 2004/044257 | 5/2004 |
| WO | 2006/122858 | 11/2006 |

* cited by examiner

METHOD FOR PRODUCING A COATED EXTENSION GUIDE

This application is a national stage of International Application PCT/EP2010/063544, filed Sep. 15, 2010, and claims benefit of and priority to German Patent Application No. 10 2009 044 011.9, filed Sep. 15, 2009, the content of which applications are incorporated by reference herein.

BACKGROUND AND SUMMARY

The present disclosure relates to a method for producing a coated pull-out guide, for example, for baking ovens. The pull-out guide includes a rail on which at least one further rail is displaceably supported by rolling elements. The rolling elements are guided along tracks on the rails.

EP 1 607 685 discloses a coating method for a telescopic rail in which a PTFE coating is applied to chrome-plated structural steel or stainless steel. For pre-treatment of the telescopic rail, first a cleaning process is carried out by means of temperature treatment and then a surface treatment for roughening the surface by sand blasting. However, this type of pre-treatment is labor-intensive and there is the risk that residues of the blasting material will remain on the running surfaces of the telescopic rail. That would disadvantageously influence the running property of a pull-out guide produced using the rail. In addition, a high expenditure of energy must be applied during the thermal surface treatment. The individual parts of a pull-out guide are treated and the telescopic rails are only mounted after applying the method described.

The present disclosure thus relates to a method for producing a coated rail which is configured to be efficient with respect to process technology, cost-optimised and energy-efficient.

The present disclosure therefore relates to a method for producing a coated pull-out guide as further disclosed and described herein, including the appended claims.

In the method according to the present disclosure, a coated pull-out guide is produced which includes a rail on which at least one further rail is displaceably supported by rolling elements. The rolling elements are guided along tracks on the rails. The pull-out guide, with the rails and the rolling elements, is initially assembled into a unit. A metal surface of at least one rail of the pull-out guide is then cleaned by a mechanical and/or chemical cleaning method before applying a coating to the cleaned metal surface.

As a result of the mechanical and/or chemical cleaning, it is within the scope of the present disclosure to avoid an additional thermal treatment which involves a high energy consumption and longer dwell time in a heat chamber. During the chemical and/or the mechanical cleaning process, according to the present disclosure, the adhesive forces of impurities on the metal surface are reduced in such a manner that the impurities can be removed by wiping or are carried away by the cleaning agent. When using a mechanical cleaning process according to the present disclosure, an additional optional step to roughen the metal surface can be omitted. This is because the surface cleaning and roughening can be carried out simultaneously in one step in the cleaning process. In this case, according to the present disclosure, a combination of chemical and mechanical cleaning can also be carried out, for example, by additionally setting a liquid cleaning agent in vibration by an ultrasound transducer. Due to the subsequent treatment of the metal surface, a reduction in the adhesion of dirt, an increase in protection against scaling, an increase in corrosion protection and/or an increased scratch resistance are achieved.

The cleaning of the metal surface, may, according to the present disclosure, take place at a temperature of 0 to 200° C., or, for example, at ambient temperature. As a result, any heating of the pull-out guide during cleaning is reduced to a minimum.

In one embodiment according to the present disclosure, the tracks on the rails remain coating-free when applying the coating so that a high running quality is achieved. The coating-free tracks can be formed, for example, by masking or covering the tracks or by pushing the rails together during the coating process. The pull-out guides, may, according to the present disclosure, be located during the coating process in the mounted, inserted state. For example, the tracks and rolling elements cannot be contaminated by coating material during coating by the spray method.

When the chemical cleaning process of the metal surface, according to the present disclosure, is used, the process may comprise the following steps:

i) inserting the pull-out guide into a cleaning chamber,
ii) cleaning the pull-out guide from impurities by wetting the surface with a cleaning solution,
iii) transferring the contaminated cleaning solution into a processing unit,
iv) processing the cleaning solution by removing impurities from the cleaning solution,
v) transferring the processed cleaning solution into a storage tank, and
vi) returning the cleaning solution into a cleaning chamber.

By circulating the cleaning agent during the cleaning process, waste products of the cleaning agent can be largely avoided. The process control additionally enables fully automatic cleaning before the coating step.

The cleaning of the metal surface can be accomplished by a blasting, or mechanical process. For example, ice blasting, ice blasting with blasting media additives, carbon dioxide pellet blasting and/or carbon dioxide snow jets can be used. These blasting process methods are advantageous since they remove both impurities and also act abrasively so that cleaning and surface roughening take place in one step. At the same time, no blasting agent residues are left on the tracks and other regions of the rails. As a result of using a blasting media additive when ice blasting, a rinsing step may be necessary to release and/or wash away the blasting medium additive. Salts, having a low water solubility, are advantageously added to the ice jet as a blasting additive. The salts increase the abrasiveness and can be removed by a rinsing step if required.

The cleaning of the metal surface can preferably be accomplished by an ultrasound process. In this case, a solvent can be applied to the surface which releases impurities from this surface by ultrasound wave initiated cavitation. Additionally or alternatively, instead of the solvent, cleaning additives or solvent mixtures can be used which reinforce the cleaning action of the solvent. These can, for example, be other solvents of different polarity, tensides, acids or alkalis and salts.

The cleaning of the metal surface, according to the present disclosure, can furthermore be accomplished by a plasma process. In this case, plasma is produced by ionization of oxygen at room temperature under vacuum, or low-pressure plasma, ambient pressure, or atmospheric plasma, or excess pressure, or high-pressure plasma. The reactive oxygen ions burn organic impurities cold to form carbon dioxide without additional thermal loading of the pull-out guide. The process is, therefore, very environmentally friendly since only oxygen is used for cleaning and non-toxic carbon dioxide, $CO_2$, and water, $H_2O$, are predominantly produced as reaction products. In addition, the vacuum technology of the plasma cleaning process can be used for a subsequent plasma coating process of the pull-out guide which allows the expenditure on apparatus to be reduced.

According to another embodiment of the present disclosure, the cleaning of the metal surface is accomplished by a laser cleaning which can eliminate severe contaminants particularly precisely.

Alternatively or additionally, according to the present disclosure, a chemical cleaning of the metal surface can take place. Liquid carbon dioxide, alkaline solutions, and/or mordants can be used for this purpose. An electrolytic cleaning using alkaline and/or acidic solution can furthermore be accomplished. When using carbon dioxide it is an advantage that this is safe and is easy to separate from the dissolved impurities. Alkaline and acidic solutions are readily available so that they are inexpensive to use. Processing of these solutions is also readily possible. Cleaning solutions used for cold cleaning and spray degreasing contain a different fraction of non-polar solvents depending on the type of impurities. These cleaning solutions can be processed by distillation and then returned into the cycle, for example, an etching process can also lead to a specific roughening of the surface. The cleaning and a possible roughening of the surface can thus take place in one process step, according to the present disclosure.

It is advantageous, according to the present disclosure, that the coating comprises PTFE, PEEK, PEK and/or inorganic-organic hybrid polymer-containing materials. These coatings have proved particularly favorable for food technology areas of application. At the same time, in particular, coatings containing inorganic-organic hybrid polymer-containing materials can also withstand temperatures above 300° C. which are attained by a conventional domestic oven in pyrolysis mode.

At the same time, it is advantageous, according to the present disclosure, if the application of the coating is accomplished by a plasma coating process since the plasma coating process has a better material adhesion with the metal surface of the pull-out guide. The spray process is advantageous, according to the present disclosure, since only the outer surfaces of the mounted pull-out guide are coated. The tracks, the rolling elements and rolling element cages remain coating-free, unlike in the conventional dipping process. The running properties of the pull-out guide are not negatively influenced. An improvement in the material adhesion is also advantageously ensured, according to the present disclosure, by applying a functional coating by a sol-gel process. A coating according to the sol-gel process can also be applied, according to the present disclosure, by the spray process.

Other aspects of the present disclosure will become apparent from the following descriptions when considered in conjunction with the accompanying drawings.

DETAILED DESCRIPTION

Figure 1:
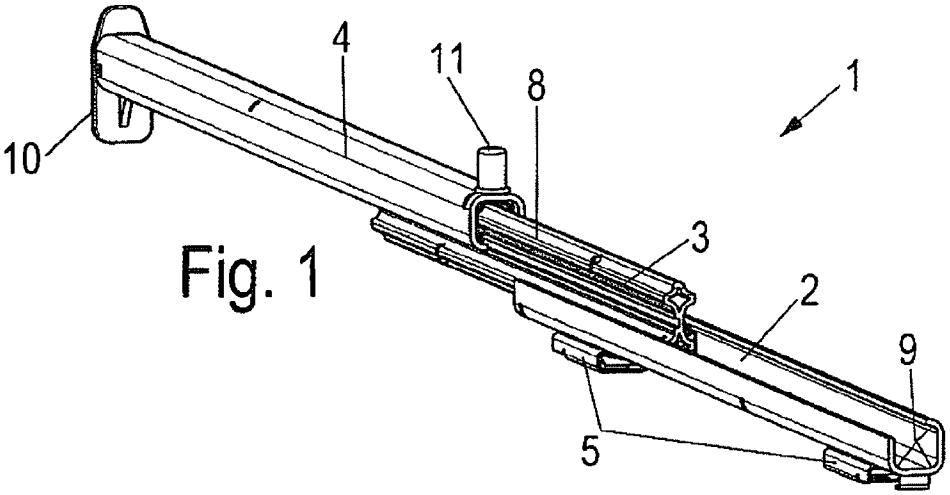
FIGS. 1 to 3 show several views of an embodiment of a pull-out guide produced using the method according to the present disclosure.

The pull-out guide 1 comprises a guide rail 2 which is configured to be fixed on a side grid in a baking oven, a side wall of a baking oven or on a furniture body. A central rail 3 is mounted displaceably on the guide rail 2 by means of rolling elements 6. The central, or middle, rail 3 is used for mounting a running rail 4. For mounting the rails 2, 3 and 4, at least two, or possibly three tracks 9 for rolling elements 6 are formed on the guide rail 2 and the running rail 4. The rolling elements 6 are held as a unit on one rolling element cage 7. It is within the scope of the present disclosure for a total of at least four tracks, or, for example, eight tracks 8 for rolling elements 6, are formed on the central rail 3. For example, at least two tracks 8 are assigned to the guide rail 2 and at least two tracks 8 are assigned to the running rail 4.

Two clips 5 are fixed on the guide rail 2 for fastening the pull-out guide 1 on a side grid, for example, of a baking oven. Other fastening means or fastening positions can also be provided in the guide rail 2, within the scope of the present disclosure.

The pull-out guide 1 is provided with, for example, a PTFE-containing coating, or polytetrafluoroethylene-containing coating on the externally accessible region, that is, on the outer side of the guide rail 2. A stopper 10 fixed on the running rail 4 is also covered, for example, with the PTFE-containing coating on its externally accessible areas. A retaining bolt 11 is equipped, for example, with a PTFE-containing coating. The inside of the running rail 4 and the guide rail 2 on which the tracks 9 for the rolling elements 6 are formed has no coating. The central rail 3, which is located completely in an inner area of the pull-out guide 1 when the running rail 4 is located in the retracted position, also has no coating, at least in the area of the tracks 8. As a result, the tracks 8 can be formed by the material of the rails 2, 3 and 4. The tracks 8 and 9 may be made from a bent steel sheet. As a result of, for example, the PTFE-containing coating on the rails 2 and 4, in accordance with the present disclosure, easy cleaning is made possible on the outer side. As a result, the pull-out guide 1 can be used efficiently in a baking oven where a high running quality is achieved over a long lifetime. FIG. 1 shows an overextension with three rails 2, 3 and 4. An embodiment, according to the present disclosure, with at least three rails is also feasible as a full extension. It is also within the scope of the present disclosure, to form the pull-out guide 1 as a partial extension with only two rails, for example, without the central rail 3, or with more than three rails.

In addition to the PTFE-containing coating, the pull-out guide 1, can within the scope of the present disclosure, have a PEEK-containing coating, or polyether ether ketone-containing coating and/or an inorganic-organic hybrid polymer containing coating.

Figure 2:
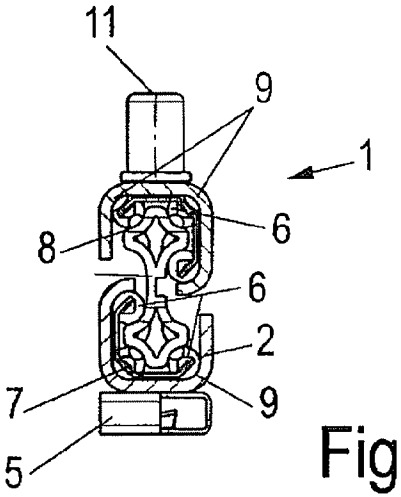
Figure 3:
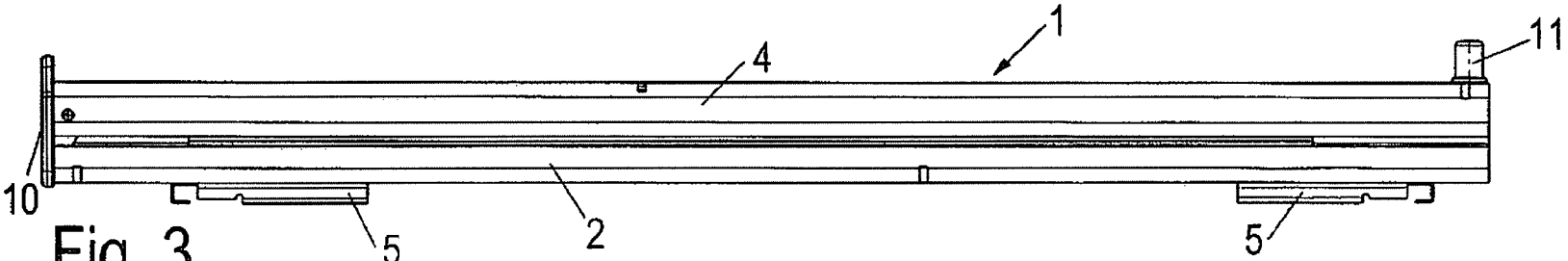

The pull-out guide shown in FIGS. 1-3 is initially assembled to form a unit according to an embodiment of a method according to the present disclosure. The assembly method and also the coating method can, for example, be fully automated, in accordance with the present disclosure.

In an embodiment of a method according to the present disclosure, the cleaning of the assembled pull-out guide is accomplished without changing the roughness by a non-abrasive cleaning method. This includes, among other things, non-abrasive blasting methods, ultrasound cleaning, plasma cleaning, laser cleaning, steam cleaning and chemical cleaning, all within the scope of the present disclosure.

In an embodiment of the method, according to the present disclosure, the assembled pull-out guide 1 is dipped in an ultrasonic bath and may be exposed to cleaning by cavitation effects for 2-30 min. The cleaning solution in the ultrasonic bath is purified water having a pH of 6-13, but, can be, for example, a pH of 7-12.

A sodium hydroxide solution may, according to the present disclosure, be used to adjust a basic pH.

A solvent for chemical cleaning may, for example, be isopropanol.

If necessary, a drying of the surface is then carried out. Then, at least in some places, the coating is applied to the cleaned surface of the pull-out guide 1.

A subsequent application of the coating thereby comprises, in accordance with the present disclosure, the application of the coating agent and then the curing of the coating by gradual heating of the coating to temperatures above 200° C. Following the coating, lubricant can be applied to the tracks in order to ensure a high running quality of the pull-out guide 1.

In an embodiment of the method according to the present disclosure, the cleaning of the assembled pull-out guide 1 is accomplished by an abrasive blasting process on the surface to be coated. Ice or dry ice can be used for this. The ice or dry ice is emitted with grains having an average grain size between 0.5 mm and 3 mm onto the surface to be cleaned at a pressure of, for example, between 2000 hPa and 20 000 hPa, or, for example, 5000 hPa to 15 000 hPa. This cleaning process simultaneously effects a cleaning and a surface roughening in one process step, in accordance with the present disclosure. Impurities are superficially dissolved by mechanical vibrations and then carried away, for example, by melt water. This is followed by a drying of the cleaned surface and the application of the coating.

In an embodiment of the cleaning according to the present disclosure, $CO_2$ snow is produced with the aid of liquid carbon dioxide from a dip-tube bottle and blasted onto the pull-out guide 1. For this purpose, $CO_2$ snow is brought into a compressed air jet and blasted onto the surface of the pull-out guide 1 at an angle between 30-90°. The working distance is 10-30 mm and the compressed air jet is at 4000-8000 hPa and has a volume flow between 1 and 8 $m^3$/h. The feed rate of the nozzle with which the $CO_2$ snow is blasted onto the pull-out guide may be, for example, between 80-120 mm/s. In this method according to the present disclosure, the consumption of liquid carbon dioxide is between 10-25 kg/h.

In an embodiment of the cleaning according to the present disclosure, $CO_2$ pellets are blasted onto the pull-out guide 1 at a pressure of, for example, 4000-6000 hPa. In this embodiment, the dry ice consumption is between 25-50 kg/h. The consumption in this embodiment is certainly higher but more strongly adhering contaminants are thereby removed. In this embodiment, a knife set can be inserted in the $CO_2$ pellet stream in order to split the pellets into small hard particles before they impinge upon the surface to be cleaned. These mostly sharp-edged particles increase the cleaning effect. When impinging upon the contaminant, this is cooled down until it becomes embrittled. The next impinging $CO_2$ particle then releases the contaminant. The compressed air assists the removal of the embrittled contaminant from the surface to be cleaned. Furthermore, the brief existence of liquid $CO_2$ when impinging upon the surface to be cleaned can be assumed, which leads to an increased cleaning effect in the case of greasy contaminants.

Furthermore, the $CO_2$ pellets can be guided separately to a two-substance nozzle with a conveying air stream in order to avoid any grinding and agglomeration of the pellets during transport to the deployment location. Compressed air to accelerate the $CO_2$ pellets for the cleaning process is supplied to the two-substance nozzle through a second hose. This arrangement leads to a further increase in the cleaning power, in particular, for example, with respect to particulate firmly adhering contaminants.

In order to add an abrasive component to the $CO_2$ cleaning process in accordance with the present disclosure, abrasive particles can be fed into the $CO_2$ snow or $CO_2$ pellet stream. Carbonates are suitable, for example, as abrasive components in the $CO_2$ cleaning process. Carbonates can be removed again from the surface to be cleaned in another aqueous cleaning step, in accordance with the present disclosure, free from residues so that there is no risk of damage to the tracks of the pull-out guide 1 to be cleaned. Furthermore, in particular, for example, salts can be used as blasting medium additives in the $CO_2$ cleaning process. These salts may have no solubility or only a low solubility in $CO_2$ but are readily soluble in water. After the $CO_2$ cleaning, they can thus be removed from the surface to be cleaned free from residues in a subsequent aqueous cleaning step, in accordance with the present disclosure.

In an embodiment of the method of the present disclosure, the roughness of the surface can be modified by electrolytic cleaning. After the drying, a coating can be applied to this surface.

In an embodiment according to the present disclosure, a chemical cleaning of the surface of the pull-out guide 1 is carried out following its assembly.

The cleaning agent laden with impurities can be recycled for re-use. This is accomplished, for example, by distillation.

A cleaning of the pull-out guide 1 with subsequent processing of a cleaning agent can be carried out as follows, in accordance with the present disclosure:

a. In a cleaning chamber, the pull-out guide 1 to be cleaned is cleaned either by spraying or by dipping the pull-out guide 1 into a bath containing cleaning agents. The cleaning power can, within the scope of the present disclosure, be improved by using ultrasound;

b. Emptying the cleaning chamber and transferring the cleaning agent to a distillation unit;

c. Additional steam cleaning of the pull-out guide 1 is within the scope of the present disclosure. This is where clean solvent vapor of the cleaning agent constituents, which is produced by the distillation unit, is fed into the cleaning chamber and condenses on the colder parts of the pull-out guide 1. The oil film residues are thus completely removed when the condensate runs from the surface;

d. The evaporation of the solvent is accelerated by generating a vacuum in the cleaning chamber and the solvent-containing air is evacuated from the working chamber; and e. Ventilation of the cleaning chamber, for example, under normal atmospheric conditions. The solvent concentration in the cleaning chamber is monitored and the charging and discharging zone is only released when the concentration lies below the values specified by VOC guidelines.

$CO_2$ snow can, within the scope of the present disclosure, also be used for cleaning the metal surface of the pull-out guide 1. The carbon dioxide snow in this case is not toxic and is ecologically safe. Unlike in sand jet blasting, in which sand residues remain on the rails and can negatively influence the running property, $CO_2$ snow sublimes free from residue after the cleaning. Hydrocarbons, greases and also silicones can be effectively removed by the $CO_2$ snow. In this case, carbon dioxide particles are ejected by the nozzles onto the surface to be cleaned and gaseous carbon dioxide is released. The adhesive forces of the impurities on the surface are cancelled by momentum transfer of the $CO_2$ snow particles. In this case, no chemical reactions of the carbon dioxide snow take place with the surface. This material-sparing procedure is advantageous in an area of the tracks of the pull-out guide 1 and ensures a high running quality. Carbon dioxide cleaning is, in this case, superior to the conventional cleaning using solvent-based cleaning agents.

Medium-fine cleaning accompanied by removal of particles having particle sizes of 10-50 μm can be accomplished by treatment of a surface with $CO_2$ snow followed by a wiping method according to VDI 2083-4, and in part using the references to methods for coarse, medium and fine cleaning specified in DIN EN ISO 14644-5. Furthermore, the cleaning effect of the carbon dioxide snow can be attributed to the release of impurities as a result of varying degrees of thermal expansion of impurities and surfaces due to the rapid temperature drop, associated with embrittlement effects.

A mixing of $CO_2$ snow and compressed air can take place after emergence from the separate nozzles or, advantageously, before emergence from a single nozzle. The cleaning effect due to the carbon dioxide snow can be increased by cleaning additives, for example, by pre-treatment of the surface with the ecologically and toxicologically safe cleaning additive, dimethyl succinate.

The adhesive strength of the coating was assessed in accordance with DIN EN ISO 2409. It has been shown that coated pull-out guide, having a cross-cut characteristic value of "1" shows good suitability for practice. However, for the coatings applied according to the present disclosure, the cross-cut characteristic value of "0" was predominantly not exceeded.

Before the cleaning and the coating, a roughness $R_a$ of less than 2 μm according to DIN 4768 was determined. The measured values were, for example, between 0.04 μm and 1.5 μm. It has been shown that the surface roughness for most of the coatings, according to the present disclosure, has a satisfactory structure for a high adhesive strength.

The coatings may, according to the present disclosure, have a layer thickness between 8 and 50 μm.

Depending on the intended use, the coatings, according to the present disclosure, may have a thermal resistance of up to 600° C.

Measurement methods and definitions follow.

Adhesive Strength

The adhesive strength of the coating, according to the present disclosure, was investigated in the cross-cut test according to DIN EN ISO 2409 (1994). In this test, a cutting device with standardised blades is drawn over the coating under specified conditions. A cutting device having 6 blades is used for the present investigations of the adhesive strength. The cutting guidance is repeated at an angle of 90° to the preceding cutting test so that the incisions produced by the blades form a grid network in the surface. A standardised transparent self-adhesive tape having an adhesive strength of 10±1 N per 25 mm width is then stuck to the surface and pulled off. The cut edges are then examined for chipping of the coating. The test results are classified in cross-cut characteristic values of 0 to 5 where the cross-cut characteristic value of 0 means that no chipping was determined.

Roughness $R_a$

The surface roughness specified in connection with the embodiments of the present disclosure, relates to the arithmetical mean deviation $R_a$ [μm] according to DIN 4768. The arithmetical mean deviation $R_a$ is the arithmetic mean of the absolute magnitudes of the distances y of the roughness profile from the central line within a measurement distance. The roughness measurement is made using electrical stylus instruments according to DIN 4772. The measurement conditions in accordance with DIN 4768 T1 are specified for the measurements of the arithmetical mean deviation $R_a$.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A method for producing a coated pull-out guide for baking ovens, the pull-out guide comprising a guide rail and at least one of a middle rail and a running rail displaceably supported by rolling elements on the guide rail, the rolling elements being guided along tracks on one or more of the guide rail, middle rail and running rail, the method comprising the following steps:

assembling the pull-out into a unit comprising one or more of the guide rail, middle rail, and running rail;

cleaning a metal surface of at least one of the rails by one or more of a mechanical and a chemical cleaning method; and applying a coating to the cleaned metal surface.

2. The method according to claim 1, wherein the cleaning of the metal surface takes place at a temperature of 0 to 200° C.

3. The method according to claim 1, wherein the tracks remain coating-free when applying the coating.

4. The method according to claim 1, wherein the cleaning is by the chemical cleaning process of the surface and comprises the following steps:

inserting the pull-out guide into a cleaning chamber;

cleaning the pull-out guide from impurities by wetting the surface with a cleaning solution;

transferring the contaminated cleaning solution into a processing unit;

processing the cleaning solution by removing impurities from the cleaning Solution;

transferring the processed cleaning solution into a storage tank; and returning the cleaning solution into a cleaning chamber.

5. The method according to claim 1, wherein the cleaning of the metal surface is accomplished by a mechanical blasting process.

6. The method according to claim 5, wherein the blasting process comprises one or more of ice blasting, ice blasting with blasting media additive, carbon dioxide pellet blasting and carbon dioxide snow jets blasting.

7. The method according to claim 1, wherein the mechanical cleaning of the metal surface is accomplished by an ultrasound process.

8. The method according to claim 1, wherein the chemical cleaning of the metal surface is accomplished by a plasma process.

9. The method according to claim 1, wherein the chemical cleaning of the metal surface is accomplished by a laser process.

10. The method according to claim 1, wherein the cleaning of the metal surface is accomplished by the chemical process using one or more of liquid carbon dioxide, alkaline solutions, chalk and mordants.

11. The method according to claim 1, wherein the cleaning of the metal surface is accomplished by the chemical process of electrolytic cleaning using one or more of an alkaline and an acidic solution.

12. The method according to claim 1, wherein the applied coating comprises one or more of polytetrafluoroethylene, polyether ether ketene and inorganic-organic hybrid polymer-containing coating.

13. The method according to claim 1, wherein the step of applying the coating is accomplished by a plasma coating process.

14. The method according to claim 1, wherein the step of applying the coating is accomplished by one or more of a sol-gel process and a spray process.

15. The method according to claim 1, wherein the step of cleaning of the metal surface takes place at ambient temperature.

* * * * *